United States Patent [19]

Kitano

[11] Patent Number: 4,588,183

[45] Date of Patent: May 13, 1986

[54] SHEET FEEDING APPARATUS

[75] Inventor: Hiroshi Kitano, Hiratsuka, Japan

[73] Assignee: Kabushiki Kaisha Komatsu Seisakusho, Japan

[21] Appl. No.: 645,623

[22] Filed: Aug. 30, 1984

[30] Foreign Application Priority Data

Sep. 2, 1983 [JP] Japan ..... 58-161755

[51] Int. Cl.[4] ..... B65H 9/10

[52] U.S. Cl. ..... 271/236; 271/243; 271/250

[58] Field of Search ..... 271/236, 237, 243, 244, 271/250, 252, 253

[56] References Cited

U.S. PATENT DOCUMENTS

| | | | |
|---|---|---|---|
| 4,127,198 | 11/1978 | Morini | 271/250 X |
| 4,164,349 | 8/1979 | Marass | 271/250 |
| 4,330,117 | 5/1982 | Weisbach | 271/250 X |

*Primary Examiner*—Richard A. Schacher

*Attorney, Agent, or Firm*—Diller, Ramik & Wight

[57] ABSTRACT

The sheet feeding apparatus is used to feed a rectangular sheet of material mounted on a table to a press or the like. A sucking and transferring means for sucking and transferring the sheet are provided to move the sheet until adjacent side edges thereof come to engage clamping means and a stop member for correctly positioning the sheet with reference to the clamping means.

7 Claims, 13 Drawing Figures

SHEET FEEDING APPARATUS

BACKGROUND OF THE INVENTION

1. Field of the Invention

This invention relates to sheet feeding apparatus which clamps a sheet of material and then feeds it to a working machine such as a press or punching machine, and more particularly a sheet feeding apparatus provided with means for correcting the position of the sheet when it is clamped.

2. Description of the Prior Art

When clamping a sheet of material mounted on a table and then transferring the clamped sheet to a press, for example, it is necessary to precisely set the sheet at a predetermined position on the table at the time of clamping the sheet with a suitable clamping device. Because, at the time of clamping, if the sheet were not set at a correct position, the relative positional relation between the sheet and the clamping device would become erroneous so that press work could not be made at the correct position of the sheet when the sheet is conveyed to the press to be pressed.

According to the prior art method, each time the sheet is mounted on the table, the positional error of the sheet has been manually corrected so that the amount of the correction is not always equal and the surface of the sheet is contaiminated by an operator's hand.

SUMMARY OF THE INVENTION

It is an object of this invention to provide a novel sheet feeding apparatus capable of automatically positioning a sheet of material with respect to a clamping device.

According to this invention, there is provided sheet feeding apparatus of the type including clamping means for clamping a rectangular sheet of material mounted on a table and means for feeding the clamping means, characterized in that there are provided means for sucking the sheet of material, means for moving the sucking means toward the clamping means along the table in a first direction and in a second direction perpendicular to the first direction, respectively over predetermined distances, a stop means against which an edge of the sheet of materical comes to engage when the same is moved in the second direction, and means for controlling the sucking and transferring means.

BRIEF DESCRIPTION OF THE DRAWINGS

In the accompanying drawings:

FIG. 5 is a connection diagram showing one example of a pneumatic circuit for operating piston-cylinder units of the sucking and transferring mechanism or the like;

DESCRIPTION OF THE PREFERRED EMBODIMENTS

Figure 1:
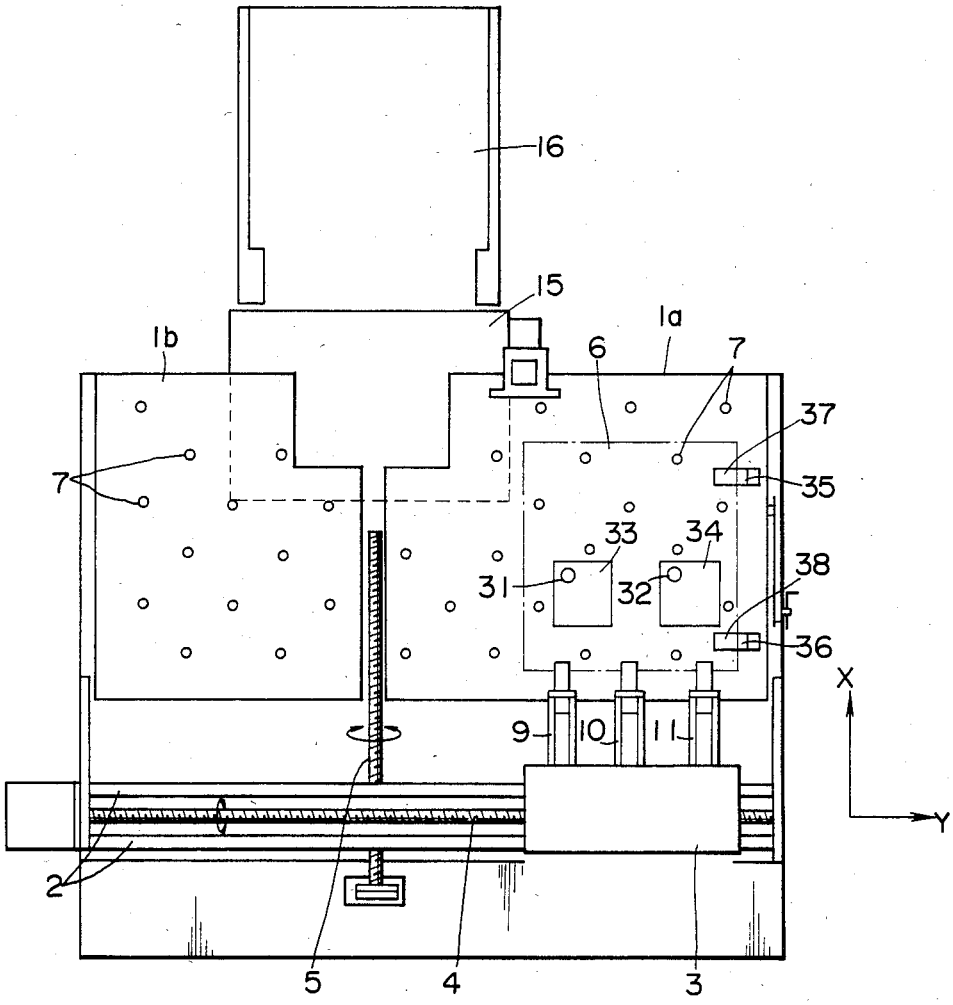
FIG. 1 is a plan view showing one embodiment of the sheet feeding apparatus according to this invention as applied to a press.

FIG. 1 shows one embodiment of this invention as applied to a press.

This embodiment comprises tables $\mathbf{1}_a$ and $\mathbf{1}_b$, guide rails 2 disposed for movement in the X direction, and a clamp carrier 3 running on the guide rails 2 in the Y direction. A ball screw 4 extending along the guide rails 2 is threaded thorugh the clamp carrier 3. Furthermore a ball screw 5 perpendicular to the ball screw 4 is threaded through guide rails 2.

Figure 2:
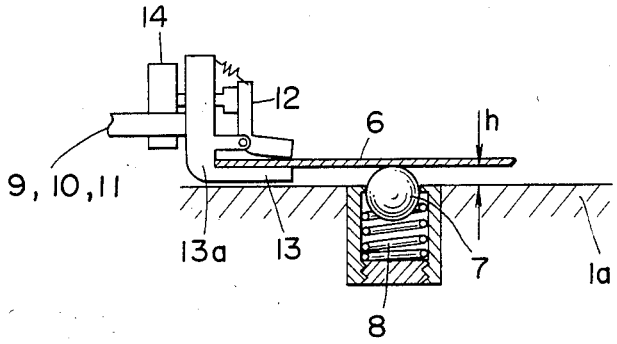
FIG. 2 is a sectional view showing the construction of a clamping pawl and the manner of installing a supporting ball.

A plurality of supporting balls 7 are embedded, at a proper spacing, in the upper surfaces of the tables 1*a* and 1*b* for the purpose of smoothly transferring a sheet 6, for example a metal sheet, and for the purposes of minimizing the member of scratches formed at the time of transferring the sheet. As shown in FIG. 2, each supporting ball 7 is normally biased upwardly by a compression spring 8 so that a portion of the ball projects above the upper surfaces of the tables 1*a* and 1*b*.

The clamp carrier 3 is provided with juxtaposed three arms 9, 10 and 11 extending in the X direction towards the table 1*a*, and a pair of clamping pawls 12 and 13 are provided for one end of each of the arms 9, 10 and 11 as shown in FIG. 2. The clamping pawl 12 is pivotally connected to the other clamping pawl 13 secured to the arm, and the piston rod of a piston-cylinder unit 14 is abutted against the rear surface of the pawl 13 so that when the piston-cylinder unit 14 is actuated, the pawl 12 is rotated in the clockwise direction as viewed in FIG. 2, thus clamping the sheet 6 between both pawls 12 and 13. The upper surface of the pawl 13 is made to be equal to the projected height h of supporting ball 7.

Ball screws 4 and 5 are driven by independent servomotors through gear machines, not shown. When the ball screw 4 is rotated, the clamp carrier 3 is moved in Y direction along the guide rails 2, whereas when ball screw 5 is rotated, the guide rails 2 are simultaneously moved in the X direction.

In FIG. 1, reference numeral 15 designates the bolster of the press 16 for supporting a lower die.

To press the sheet 6, the sheet 6 is mounted on the table 1*a* and clamped by pawls 12 and 13 of arms 9, 10 and 11 (See FIG. 2). The clamp carrier 3 is moved in the X direction by a predetermined distance, and thereafter the clamp carrier 3 is moved in the Y direction. After the edge of the sheet 6 has been transferred to the central portion of the bolster 9, the sheet 6 is stepwisely moved in the Y direction (to the left) and in synchronism therewith, the upper die, not shown, is operated to perform press work. As a consequence, press works are performed on the sheet at a predetermined pitch in the Y direction, this sequentially punching printed marks.

When punchings along one row in the Y direction are complete the sheet 6 is moved in the X direction by a predetermined distance to punch printed marks of the next row. The feeding and punching operations of the sheet 6 by the clamp carrier 3 are executed by a numerically controlled program as is well known in the art.

Figure 3:
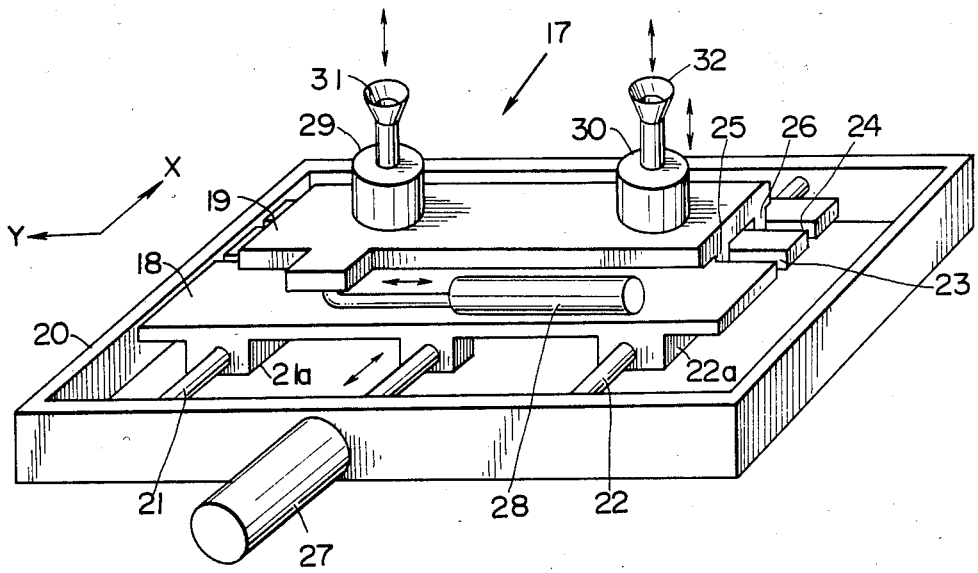
FIG. 3 is a perspective view diagrammatically showing the construction of a sucking and transferring mechanism.

The sheet feeding apparatus is provided with a sucking and transferring mechanism 17 shown in FIG. 3 beneath the table $1_1$. The mechanism 17 has movable tables 18 and 19. Guide rods 21 and 22 provided in the X direction and secured to a rectangular frame 20 extend through blocks 21*a* and 22*b* secured to the lower surface of the table 18, and the lower projections 25 and 26 are received in guide grooves 23 and 24 provided for the table 18 to extend in the Y direction.

A pneumatic cylinder 27 is secured to one side of frame 20 to extend in the X direction, while a pneumatic cylinder 28 is secured to the table 18 to extend in the Y direction. The piston rod of cylinder 27 is connected to table 18 and the piston rod of cylinder 28 is connected to table 19.

Vertical pneumatic cylinders 29 and 30 are secured to the table 19 at a suitable spacing in the Y direction and suction cups 31 and 32 made of elastic material, for example, rubber are secured to the upper ends of the piston rods of cylinders 29 and 30 respectively.

Since the sucking and transferring mechanisms are constructed as above described by actuating cylinders 27 and 28, vacuum cups 31 and 32 can be simultaneously moved in the X and Y directions by distances corresponding to the strokes of the pistons of the cylinders 27 and 28. Furthermore, by actuating cylinders 29 and 30 vacuum cups 31 and 32 can be raised or lowered.

Figure 4:
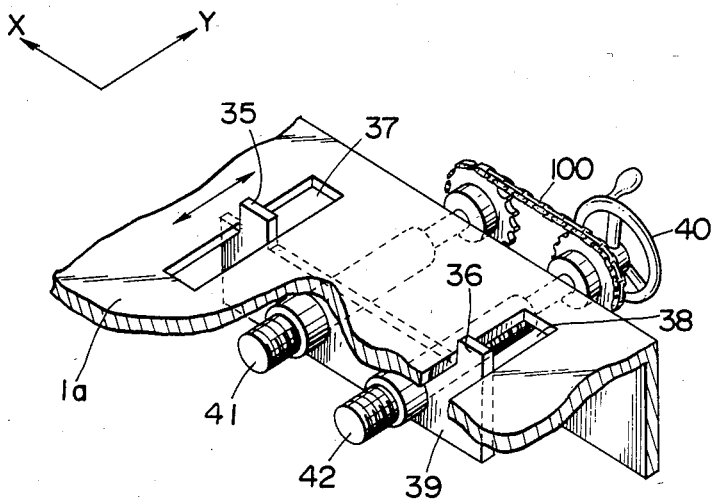
FIG. 4 is a perspective view, partly in section, showing the manner of arranging stop members and their adjusting device.
Figure 5:
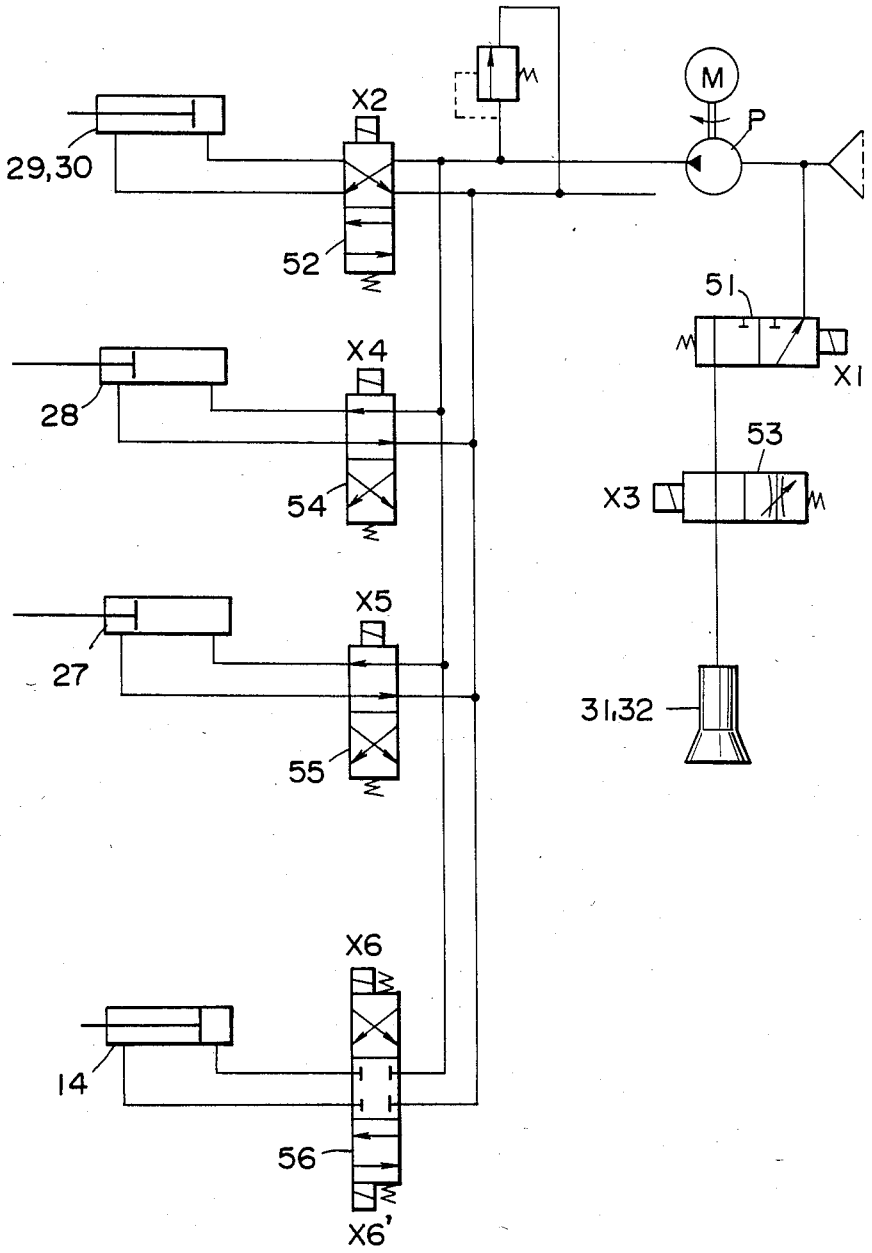

In this embodiment, as shown in FIG. 1, the table 1*a* is formed with rectangular windows 33 and 34 at portions thereof above vacuum cups 31 and 32, and grooves 37 and 38 are provided for the righthand end of the table 1*a* to guide stop members 35 and 36 to extend in the Y direction. As shown in FIG. 4, the stop members 35 and 36 project above the upper surface of the table 1*a* through guide slots 37 and 38 respectively. The plate member 39 is threaded through threaded rods, which are coupled together through sprocket wheels and a chain 100, and a handle 40 is secured to one threaded rod 42. Consequently, when the handle 40 is rotated, the stop members 35 and 36 are moved simultaneously in the Y direction along grooves 37 and 38. FIG. 5 shows one example of a pneumatic circuit for operating pneumatic cylinders 27–30 and vacuum cups 31 and 32 shown in FIG. 3 and piston-cylinder unit 14 shown in FIG. 2, and FIG. 6 shows one example of a sequence circuit for transfer controlling electromagnetic transfer valves 51–56 of the pneumatic circuit.

Figure 7:
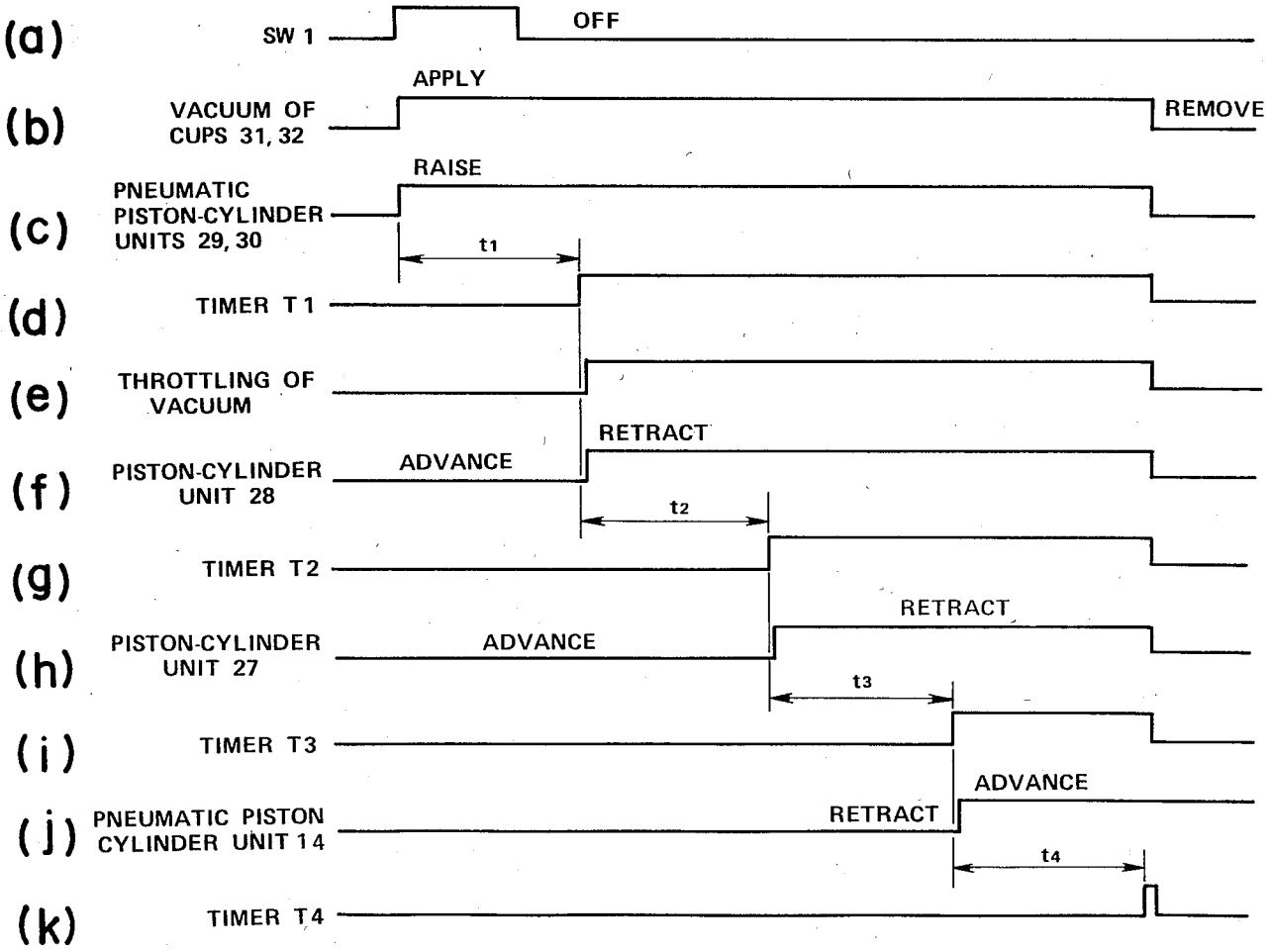
FIG. 7 is a timing chart useful to explain the sequence operation of the circuit shown in FIG. 6.
Figure 8A:
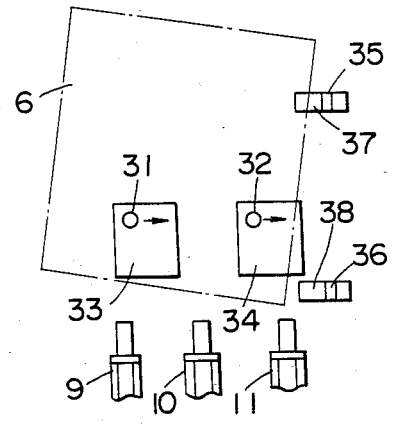
FIGS. 8*a*–8*c* diagrammatically show the manner of positioning the sheet.

It is now supposed that a sheet 6 is mounted on the table 1*a* in a manner as shown in FIG. 8*a*. At this time when a push button SW1 shown in FIG. 6 is closed a relay R1 is operated and selfholds through the push button SW, where by coils X1 and X2 of electromagnetic transfer valves 51 and 52 shown in FIG. 5 are energized to transfer these valves. As a consequence, pump P applies a negative pressure to vacuum cups 31 and 32 and the piston-cylinder units 29 and 30 raise vacuum cups 31 and 32 (see FIGS. 7*b* and 7*c*) so that vacuum cups engage the lower surface of the sheet 6 to suck the same.

Figure 6:
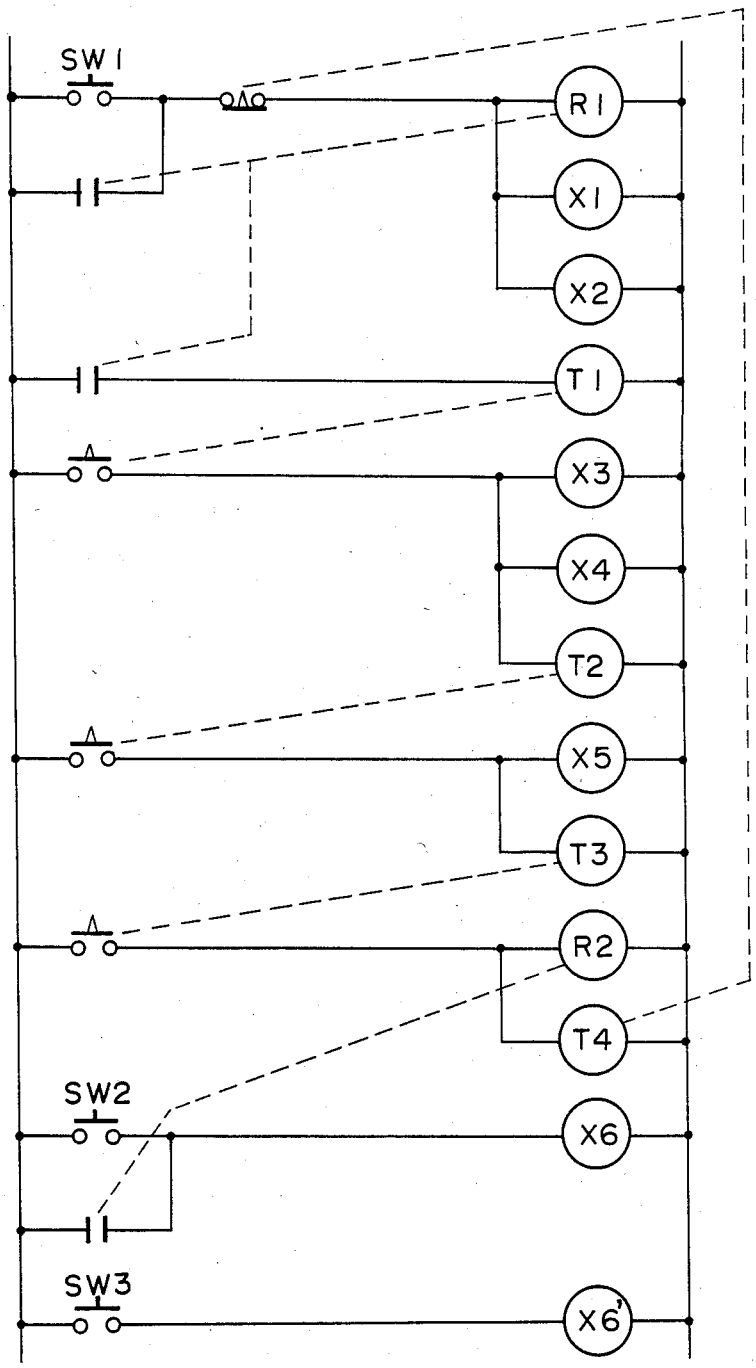
FIG. 6 shows one example of a sequence circuit for controlling the electromagnetic transfer valves shown in FIG. 5.

A timer T1 shown in FIG. 6 is of the on-delay type started by the operation of relay R1 and is set with a time t1 required to advance the pistons of the piston-cylinder units 29 and 30 by their maximum strokes, that is, the time $t_1$ required for raising the vacuum cups 31 and 32 to suck the sheet 6. When the timer time $t_1$ is over as shown in FIG. 7*d*, the contact of the timer is closed to energize the coils X3 and X4 of the electromagnetic transfer valves 53 and 54 shown in FIG. 5 to operate these transfer valves and to start a second on-delay timer T2. Consequently the suction force to the sheet 6 applied by vacuum cups 31 and 32 is decreased by the throttling action of valve. At the same time the piston of the pneumatic cylinder 28 is retracted to move the vacuum cups 31 and 32 to the right together with the movable table 19.

Figure 8B:
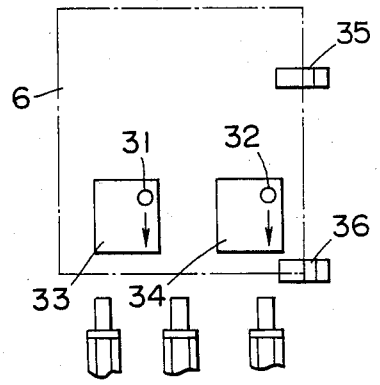

As the vacuum cups 31 and 32 are moved, sheet 6 is also moved to the right as shown in FIG. 8*b*. During this movement a side edge of the sheet engages with stop members 35 and 36 to be corrected its attitude.

After engaging the sheet 6 against stop members 35 and 36, the vacuum cups 31 and 32 slide along the lower surface of the strip 6 until the piston of piston-cylinder unit 28 reaches its stroke end. Because by the throttling action of valve 53 the sucking force of the vacuum cups 31 and 32 is decreased.

When the piston of the piston-cylinder unit 28 reaches its stroke end, the second on-delay timer $T_2$ completes its timing operation of time $t_2$ shown in FIG. 7*g*. At the same time, the coil X5 of the electromagnetic valve 55 is energized to start a third on-delay timer T3.

Figure 8C:
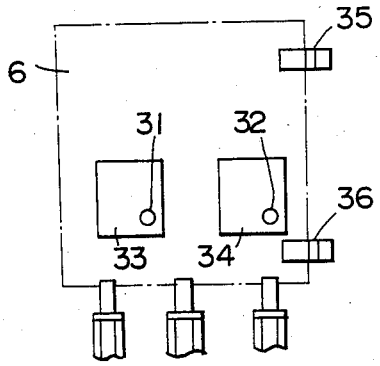

As the electromagnetic transfer valve 55 is operated, the piston of the piston-cylinder unit 27 is retracted to move the sheet 6 towards the clamping pawls 12 and 13 of respective arms 9, 10 and 11. When an edge of the sheet 6 engages the base surface 13*a* of the lower clamping pawl 13 (see FIG. 8*c*), the vacuum cups 31 and 32 would slide along the lower surface of the sheet 6 until the piston of the piston-cylinder assembly 27 reaches its stroke end.

At the time when the sheet 6 engages against the end surface 13*a* of the clamping pawl 13, the sheet 6 is maintained at a correct attitude so that the following clamping operation takes place. More particularly, when the piston of the piston-cylinder unit 27 reaches its stroke end, the timer T3 completes its timing operation of time $t_3$ as shown in FIG. 7*i* to close its contact, whereby relay R2 is energized to start a fourth timer T4. As a consequence, since the coil X6 of the electromagnetic transfer valve 56 is energized through the contact of relay R2, whereby the piston of the clamping piston-cylinder unit 14 shown in FIG. 2 is advanced to clamp the sheet 6 as shown in FIG. 2. As the timer T4 counts the timer $t_4$ necessary for the piston to reach its stroke end, the contact of the timer T4 is opened to interrupt the self-holding circit of relay R1. Deenergization of this relay deenergizes timers T1–T4 so that the electromagnetic transfer valves 51–55 are transferred to the positions shown in FIG. 5 with the result that the vacuum cups 31 and 32 return to the positions shown in FIG. 8*a* to be positioned beneath the upper surface of table $1_1$.

The sheet 6 clamped by the pawls 12 and 13 is moved to a position above the bolster by the movement of the clamp carrier 3 in the X and Y directions. At the time when the timer T4 is deenergized, the electromagnetic transfer valve 56 returns to its neutral position so that the clamping piston-cylinder unit 14 continues to clamp the sheet. To release this clamping operation, push button switch SW3 shown in FIG. 6 is closed. Then the coil X6' of the electromagnetic transfer valve 56 is energized to transfer it in the reverse direction. Consequently, the piston-cylinder unit 14 is actuated in a direction to release the pawls 12 and 13 from the clamping.

Figure 9:
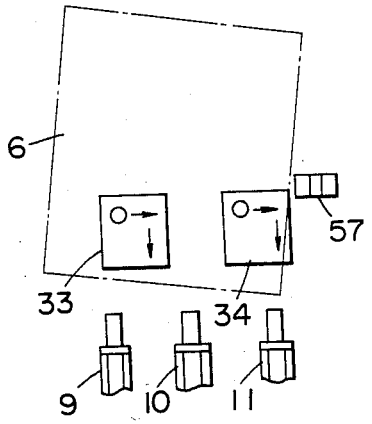
FIG. 9 shows an example utilizing only one stop member.

Although in the foregoing embodiment, two stop members 35 and 36 are used, even when only one stop member 57 is used as shown in FIG. 9, the sheet 6 can be correctly positioned. When only one stop member 57 is used, the sheet 6 can be accurately positioned even though its vertical attitude is not so accurate.

Figure 10:
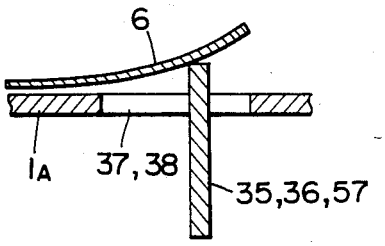
FIG. 10 is a sectional view showing warping of a sheet.
Figure 11:
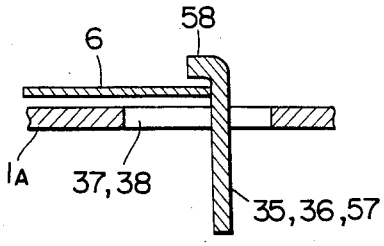
FIG. 11 is a sectional view showing another example of the stop member.

When the thickness of the sheet is small, there is a fear that the end of the sheet deflects to project beyond stop members as shown in FIG. 10 when the edge come to engage the stop members 35, 36 or 37, this can be prevented by bending horizontally the upper ends of the stop members as shown in FIG. 11.

What is claimed is:

1. In a sheet feeding apparatus having clamping means for clamping a rectangular material sheet placed on a table, and means for feeding said clamping means to a desired position, the improvement comprises:

sucking means for sucking said sheet, transferring means for transferring said sheet sucked by said sucking means toward said clamping means along said table in a first direction and a second direction perpendicular to said first direction, stopper means for engaging an edge of said sheet when the sheet is moved in said second direction, transfer control means for controlling said transferring means such that the amounts of transfer in said first and second directions is enough to engage ends of said sheet with the end surface of said clamping means and said stop means, sucking control means for controlling sucking force of said sucking means such that said sucking means is slidable on said sheet after said sheet is stopped.

2. The apparatus according to claim 1 wherein said sucking means comprises a vacuum cup, means for applying a negative pressure to said vacuum cup, and means for moving said vacuum ccup in a third direction orthogonal to said table.

3. The apparatus according to claim 1 wherein said sucking means comprises a vacuum cup, means for applying a negative pressure to said vacuum cup, means for moving said vacuum cup in a third direction orthogonal to said table, and said means for moving said vacuum cup in said third direction comprises a fluid pressure piston cylinder unit.

4. Apparatus according to claim 1 wherein said means for transferring said sucking means in said first and second directions comprises fluid pressure piston cylinder units.

5. The apparatus according to claim 1 wherein said sucking and transferring means are disposed beneath said table.

6. The apparatus according to claim 1 wherein said stop means is provided with means for adjusting its position in said second direction.

7. The apparatus according to claim 1 wherein said stop member is provided at an upper end thereof with a projection that prevents floating up of said sheet of material.

* * * * *